US011217372B2

(12) United States Patent
Jung et al.

(10) Patent No.: US 11,217,372 B2
(45) Date of Patent: Jan. 4, 2022

(54) COIL COMPONENT

(71) Applicant: SAMSUNG ELECTRO-MECHANICS CO., LTD., Suwon-Si (KR)

(72) Inventors: Min Ki Jung, Suwon-Si (KR); Hee Soo Yoon, Suwon-Si (KR); Sang Jong Lee, Suwon-Si (KR); Seung Hee Hong, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 542 days.

(21) Appl. No.: 16/032,745

(22) Filed: Jul. 11, 2018

(65) Prior Publication Data

US 2019/0156977 A1 May 23, 2019

(30) Foreign Application Priority Data

Nov. 22, 2017 (KR) ..... 10-2017-0156356

(51) Int. Cl.

| | |
|---|---|
| ***H01F 5/00*** | (2006.01) |
| ***H01F 5/04*** | (2006.01) |
| ***H01F 27/29*** | (2006.01) |
| ***H01F 27/28*** | (2006.01) |
| ***H01F 17/00*** | (2006.01) |

(52) U.S. Cl.

CPC ..... *H01F 5/04* (2013.01); *H01F 17/0013* (2013.01); *H01F 27/2804* (2013.01); *H01F 27/292* (2013.01); *H01F 2027/2809* (2013.01)

(58) Field of Classification Search

CPC ..... H01F 5/04; H01F 27/2804
USPC ..... 336/200, 232
See application file for complete search history.

(56) References Cited

U.S. PATENT DOCUMENTS

| | | | | |
|---|---|---|---|---|
| 2005/0174208 | A1* | 8/2005 | Sato | H01F 17/0033 336/200 |
| 2006/0038651 | A1* | 2/2006 | Mizushima | H01F 17/04 336/83 |
| 2013/0062994 | A1* | 3/2013 | Ogawa | H01G 4/30 310/311 |
| 2015/0102891 | A1* | 4/2015 | Yoon | H01F 27/2804 336/200 |
| 2017/0092410 | A1* | 3/2017 | Sado | H01F 27/255 |
| 2017/0162317 | A1* | 6/2017 | Taniguchi | H01F 41/10 |
| 2017/0207018 | A1 | 7/2017 | Jung | |
| 2018/0226181 | A1* | 8/2018 | Aoki | B65H 75/18 |
| 2018/0315542 | A1* | 11/2018 | Hayashi | H01F 27/2823 |

FOREIGN PATENT DOCUMENTS

| | | | |
|---|---|---|---|
| JP | 2002-305111 | A | 10/2002 |
| KR | 10-2017-0086802 | A | 7/2017 |

* cited by examiner

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes a body including an internal coil and including an upper surface and a lower surface opposing each other in a thickness direction thereof; a first external electrode connected to one end of the internal coil; and a second external electrode connected to the other end of the internal coil. The first external electrode and the second external electrode may be formed on the same one side portion of the lower surface of the body.

20 Claims, 5 Drawing Sheets

COIL COMPONENT

CROSS-REFERENCE TO RELATED APPLICATION(S)

This application claims the benefit of priority to Korean Patent Application No. 10-2017-0156356 filed on Nov. 22, 2017, in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive element constituting an electronic circuit together with a resistor and a capacitor. As an electronic device on which an electronic circuit is formed is miniaturized, it is necessary for the coil component, for example, an inductor, to also be miniaturized.

Accordingly, a chip inductor formed using a lamination method is recently developed. Such a laminated inductor is required to be usable at a high frequency of 100 MHz or more, due mainly to a self resonance frequency (SRF) of a high frequency band and low specific resistance.

In addition, in order to reduce loss in a frequency of a device, high quality factor Q characteristics are required. Accordingly, there is a demand for a coil of a coil component which may be miniaturized while satisfying such high Q characteristics.

SUMMARY

An aspect of the present disclosure may provide a small coil component which may satisfy high Q characteristics.

According to an aspect of the present disclosure, a coil component may include a body including an internal coil and including an upper surface and a lower surface opposing each other in a thickness direction thereof; a first external electrode connected to one end of the internal coil; and a second external electrode connected to the other end of the internal coil. The first external electrode and the second external electrode may be formed on the same one side portion of the lower surface of the body.

According to another aspect of the present disclosure, a coil component may include a body including an internal coil and including an upper surface and a lower surface opposing each other in a thickness direction thereof and a first end surface and a second end surface opposing each other in a length direction thereof; a first external electrode connected to one end of the internal coil; and a second external electrode connected to the other end of the internal coil. The first external electrode and the second external electrode may be formed on a first end surface of the body.

In the summary, all of features of the present disclosure are not mentioned. Various units for solving an object of the present disclosure may be understood in more detail with reference to specific exemplary embodiments of the following detailed description.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
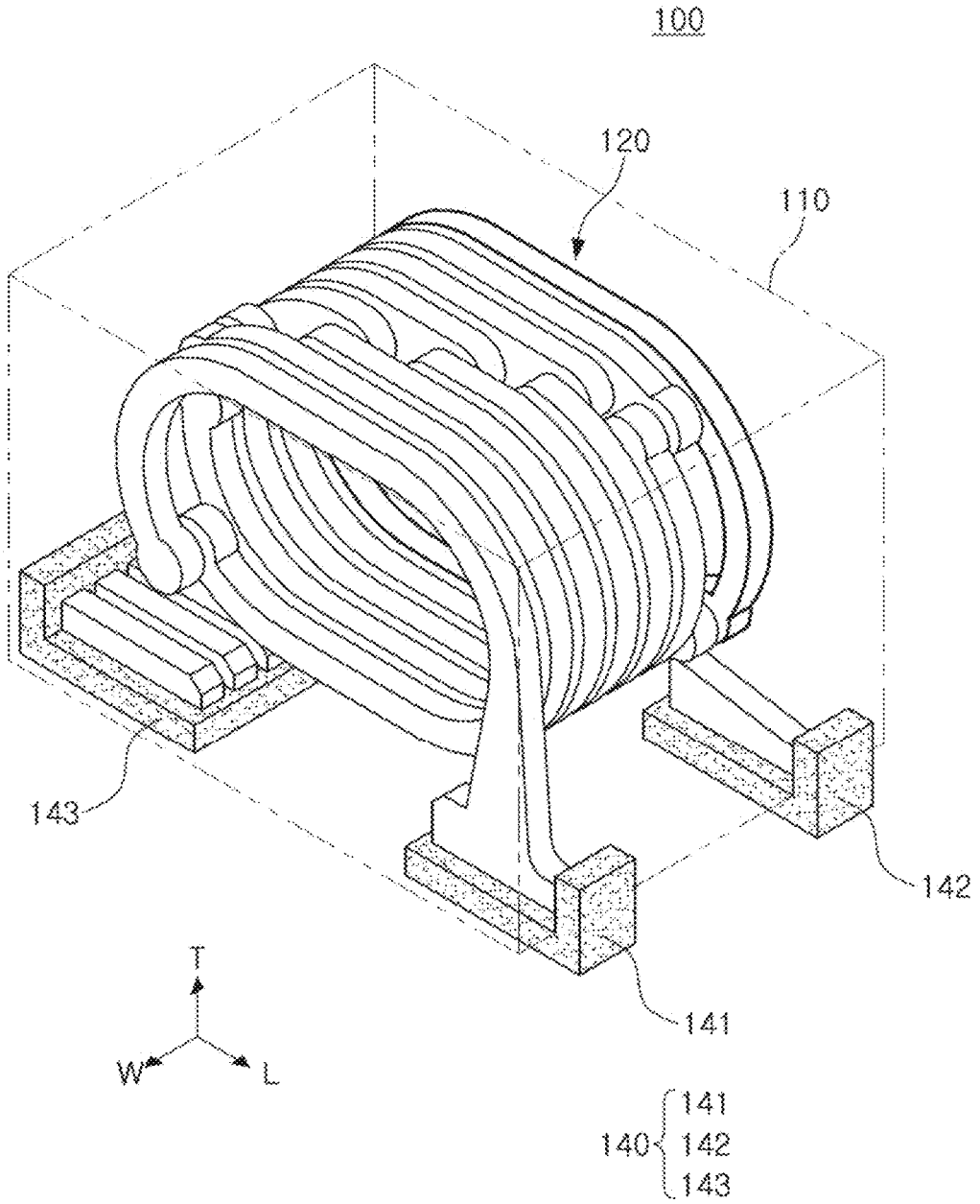
FIG. 1 is a perspective view illustrating one example of a coil component according to an exemplary embodiment in the present disclosure.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

A coil component according to an exemplary embodiment in the present disclosure may be configured so that external terminals corresponding to both ends of a coil are formed together on one side of a body part of the coil component. Accordingly, a flow of flux becomes smooth and a change of resistance characteristic by electrodes is significantly reduced, such that Q factor characteristics of the coil component may be improved.

Hereinafter, the present disclosure will be described in detail with reference to the accompanying drawings.

Figure 2:
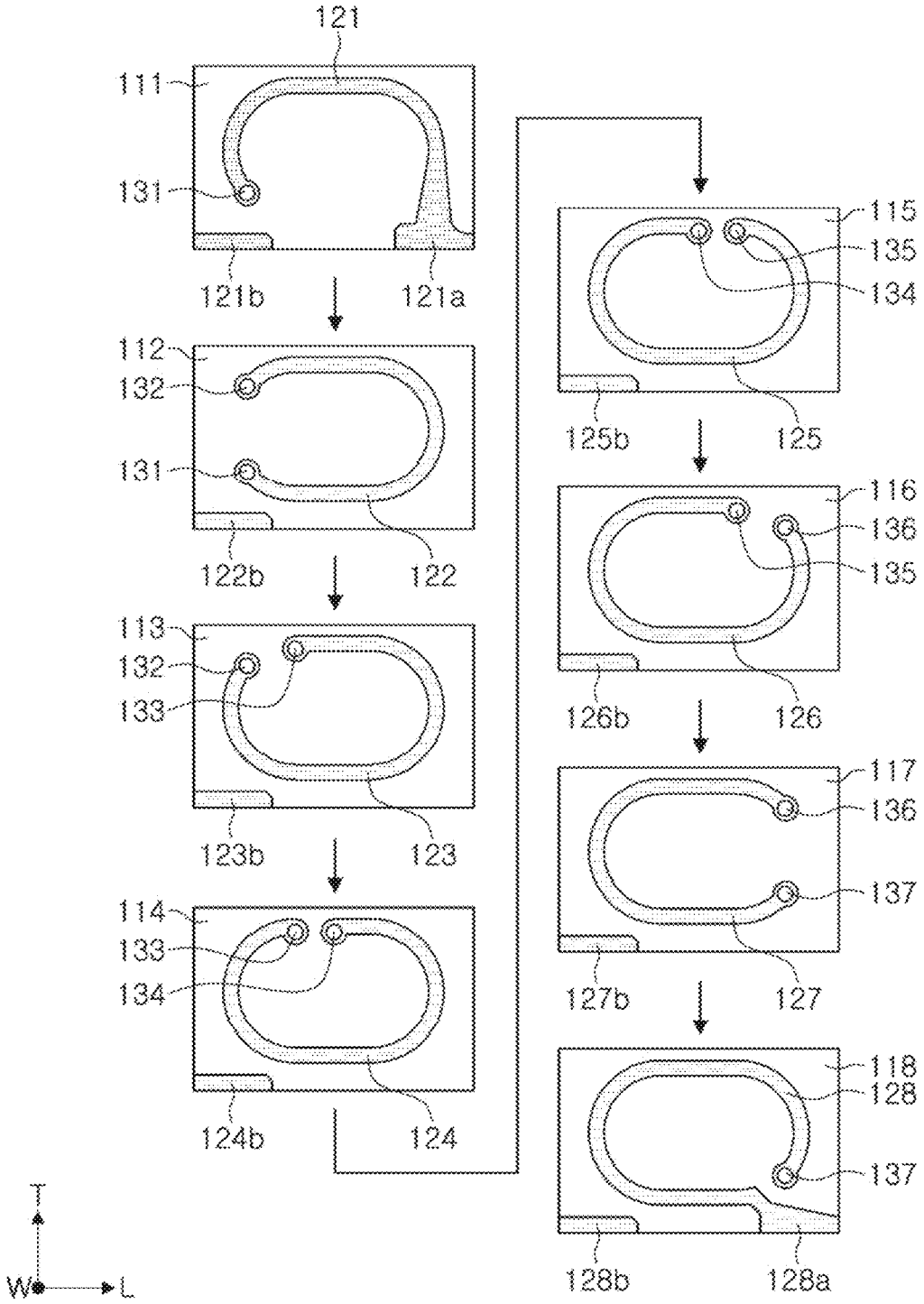
FIG. 2 is a front view of a plurality of body sheets included in the coil component illustrated in FIG. 1.

FIG. 1 is a perspective view illustrating one example 100 of such a coil component. FIG. 2 is a front view of a plurality of body sheets included in the coil component illustrated in FIG. 1 and FIG. 3 is a front view of the coil component illustrated in FIG. 1.

Figure 3:
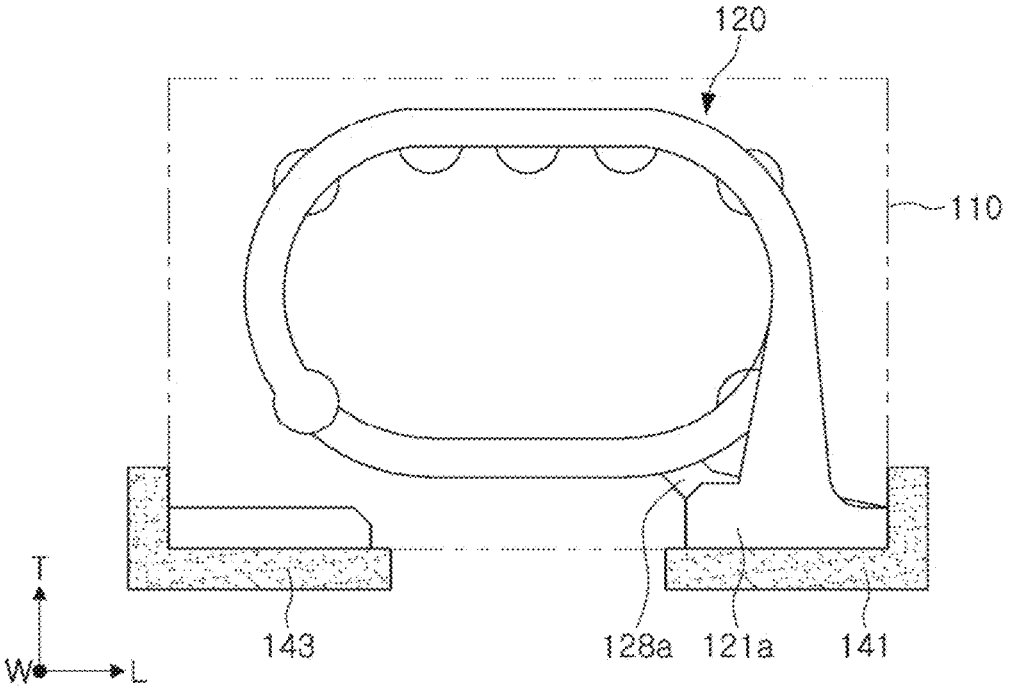
FIG. 3 is a front view of the coil component illustrated in FIG. 1.

Referring to FIGS. 1 through 3, a coil component 100 may include a body part 110 and a plurality of external electrodes 140.

The body part 110 may substantially determine an outer shape of the coil component. The body part 110 may include an upper surface and a lower surface opposing each other in a thickness T direction thereof, a first end surface and a second end surface opposing each other in a length L direction thereof, and a front surface and a rear surface opposing each other in a width W direction thereof. The body part 110 may have a hexahedral shape as in the illustrated example, but is not limited thereto.

A material forming the body part 110 may be appropriately selected in consideration of characteristics to be implemented by the coil component. For example, in a case in which the coil component 100 is applied to a high frequency inductor, a ceramic powder, or the like may be used so that a closed magnetic path is easily formed using a dielectric material.

According to the present exemplary embodiment, a manufacturing method configuring the body part 110 is not particularly limited. Various methods may be used as the manufacturing method configuring the body part 110. For example, a stacking method for stacking a plurality of dielectric sheets, disposing a conductive material for an internal coil on each of the sheets, and then connecting the sheets to each other through a via may be used. Alternatively, as another example, a method for encapsulating and embodying an internal coil of a spiral shape which is manufactured in advance with a dielectric material or the like may also be used.

Here, as illustrated in FIG. 2, an example in which the body part 110 is formed by stacking a plurality of body sheets 111 to 116 will be described, but the body part 110 may also be formed by the method for encapsulating and embodying the internal coil of the spiral shape which is manufactured in advance with the dielectric material or the like.

The body part 110 may include an internal coil 120. The central axis of the internal coil 120 may be formed in a horizontal direction with respect to a mounting surface of the body part—a surface on which the coil component is mounted when the coil component is mounted on a printed circuit board—, that is, a lower surface of the body part 110 in the illustrated example. That is, as illustrated, the internal coil 120 may be wound around a horizontal direction with respect to the mounting surface. Accordingly, an influence between the mounting surface and a magnetic field generated in an inductor may be significantly reduced. Accordingly, an influence on inductance may be significantly reduced.

The internal coil 120 may be wound while having both ends, that is, one end and the other end. One end and the other end of the internal coil 120 may be connected to first and second external electrodes 141 and 142, respectively.

As illustrated in FIG. 2, the internal coil 120 may include a plurality of coil patterns 121 to 128 formed in each of the plurality of body sheets 111 to 116, and one or more via electrodes 131 to 137 penetrating through an insulating layer (not shown) formed between the plurality of body sheets.

In addition, the internal coil 120 may include internal electrode patterns formed between the internal coil and external electrodes.

For example, the internal coil 120 may include a first internal electrode pattern 121*a* connected to one end of the internal coil and a first external electrode 141, and a second internal electrode pattern 128*a* connected to the other end of the internal coil and a second external electrode 142.

Therefore, both ends of the internal coil 120 may be connected to the first and second external electrodes 141 and 142, respectively, through the first and second internal electrode patterns 121*a* and 128*a*. By such internal electrode patterns, contact reliability between the internal coil 120 and the external electrodes may be increased.

As an example, as illustrated, an exposed shape of the first internal electrode pattern 121*a* may correspond to an exposed shape of the second internal electrode pattern 128*a*. Meanwhile, a shape of the first internal electrode pattern 121*a* may be different from a shape of the second internal electrode pattern 128*a*. This is to increase quality reliability by forming a contact environment with the external electrodes to be the same by allowing the exposed shapes of the first and second internal electrode patterns 121*a* and 128*a* in the body part 110 to correspond to each other, even if the first and second internal electrode patterns 121*a* and 128*a* are connected to the internal coil 120 at different points or positions and have different shapes.

Meanwhile, as in the example illustrated in FIGS. 1 through 3, the first and second external electrodes 141 and 142 may be formed together on one side of the body part 110.

For example, the first and second external electrodes 141 and 142 may be formed on the mounting surface of the body part 110, that is, one side portion of the lower surface of the body part 110. For example, the first and second external electrodes 141 and 142 may be formed on a right side portion of the lower surface of the body part adjacent to a first end surface in the lower surface of the body part—a right end surface in the illustrated example.

As an example, the first and second external electrodes 141 and 142 may be formed on a first end surface of the body part 110.

As an example, the first and second external electrodes 141 and 142 may protrude from one side portion of the lower surface of the body part 110 and an outer portion of the first end surface thereof.

Meanwhile, the first external electrode 141 and the second external electrode 142 may be physically spaced apart from each other. In addition, an external electrode may not be formed between the first external electrode 141 and the second external electrode 142.

In addition, a coil component 100 may include a dummy external electrode 143. The dummy external electrode 143 may be electrically insulated from the internal coil 120. The body part 110 may include dummy patterns 121*b* to 128*b* connected to a dummy external electrode 143. However, the dummy patterns may not be formed or may be variously modified according to exemplary embodiments.

The dummy external electrode 143 may be formed at a position symmetrical to the first and second external electrodes 141 and 142.

For example, in a case in which the first and second external electrodes 141 and 142 are formed on the mounting surface of the body part 110, that is, one side portion of the lower surface of the body part 110, the dummy external electrode 143 may be formed on the other side portion of the lower surface of the body part 110. That is, in the illustrated example, the first and second external electrodes 141 and 142 may be formed on the right side portion of the lower surface of the body part adjacent to the right end surface of the body part, and the dummy external electrode 143 may be formed on the left side portion of the lower surface of the body part adjacent to the left end surface of the body part.

For example, the first and second external electrodes 141 and 142 may protrude from one side portion of the lower surface of the body part 110 and an outer portion of the first end surface thereof, and the dummy external electrode 143 may protrude from the other side portion of the lower surface of the body part 110 and an outer portion of a second end surface thereof. That is, in the illustrated example, the first and second external electrodes 141 and 142 may protrude from the right side portion and the right end surface of the lower surface of the body part adjacent to the right end surface of the body part, and the dummy external electrode 143 may protrude from the left side portion and the left end surface of the lower surface of the body part adjacent to the left end surface of the body part.

In the illustrated example, the first and second external electrodes 141 and 142 may be formed in a shape similar to an alphabet L letter. By forming the external electrodes in the shape of L letter, a contact area between the external electrodes and a contact means on the mounting surface may be increased.

Figure 4:
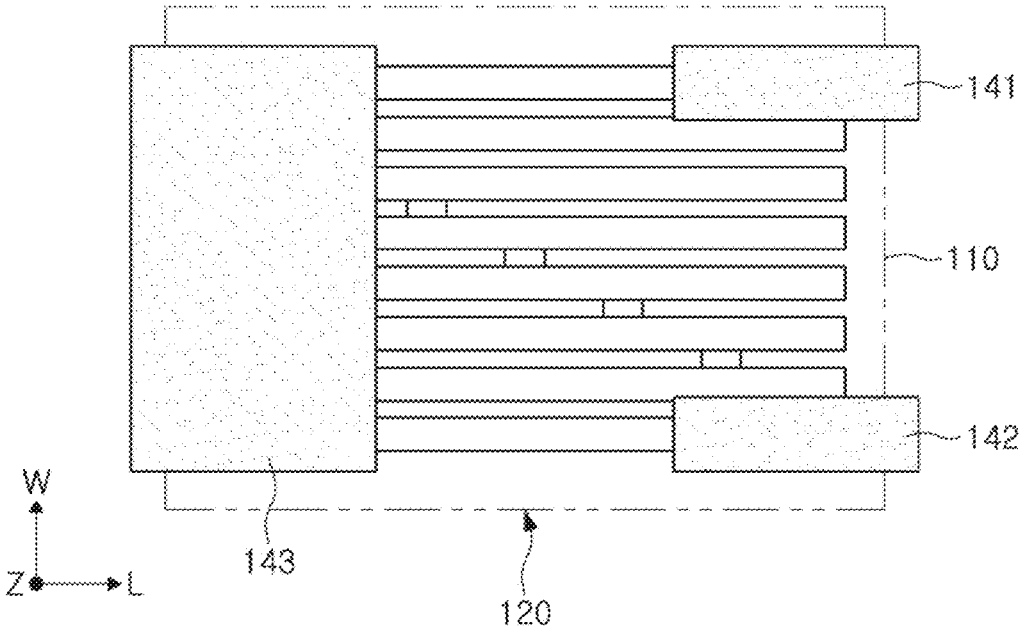
FIG. 4 is a bottom view according to one example of the coil component illustrated in FIG. 1.

FIG. 4 is a bottom view according to one example of the coil component illustrated in FIG. 1.

Referring to FIG. 4, it may be seen that the first and second external electrodes 141 and 142 connected to both ends of the internal coil 120 are formed on one end surface of the body part, and the dummy external electrode 143 is formed at a position opposite to the first and second external electrodes 141 and 142.

As described above, the dummy external electrode 143 may be variously formed. FIG. 4 illustrates an example in which the dummy external electrode 143 is formed as one electrode.

Such a dummy external electrode 143 may have a shape corresponding to the first and second external electrodes 141 and 142 connected thereto, and may allow the coil component 100 to be smoothly mounted.

In addition, since the shapes or areas of the dummy external electrode 143 and the first and second external electrodes 141 and 142 are different from each other, the mounting position of the coil component may be accurately confirmed.

Figure 5:
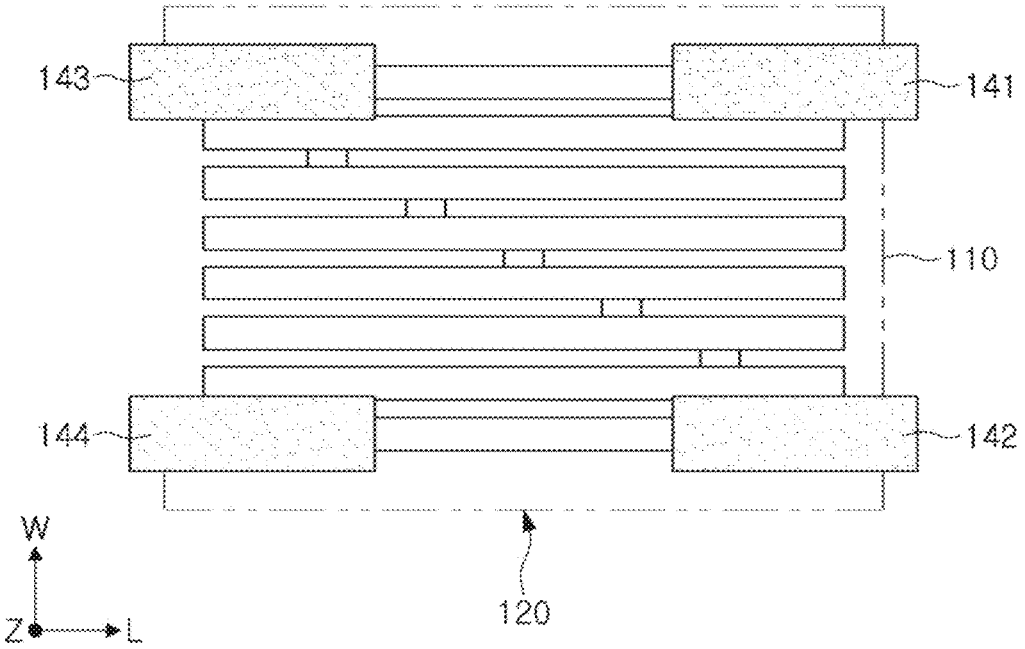
FIG. 5 is a bottom view according to another example of the coil component illustrated in FIG. 1.

FIG. 5 is a bottom view according to another example of the coil component illustrated in FIG. 1.

Referring to FIG. 5, it may be seen that the first and second external electrodes 141 and 142 connected to both ends of the internal coil 120 are formed on one end surface of the body part, and the first and second dummy external electrodes 143 and 144 are formed at positions corresponding to the first and second external electrodes 141 and 142.

For example, the first and second external electrodes 141 and 142 may be formed on one side portion of the lower surface of the body part, and the first and second dummy external electrodes 143 and 144 may be formed on the other side portion of the lower surface of the body part to face the first and second external electrodes 141 and 142.

For example, the first dummy external electrode 143 may be formed in a position symmetrical to the first external electrode 141 with respect to the center line of the lower surface. The second dummy external electrode 144 may be formed in a position symmetrical to the second external electrode 142 with respect to the center line of the lower surface.

Figure 6:
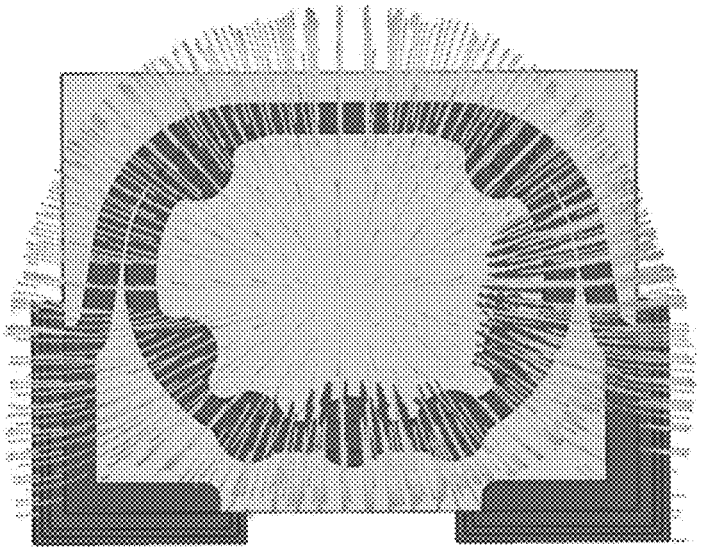
FIG. 6 is a view illustrating a formation of a magnetic field in a coil component according to a comparative example.
Figure 7:
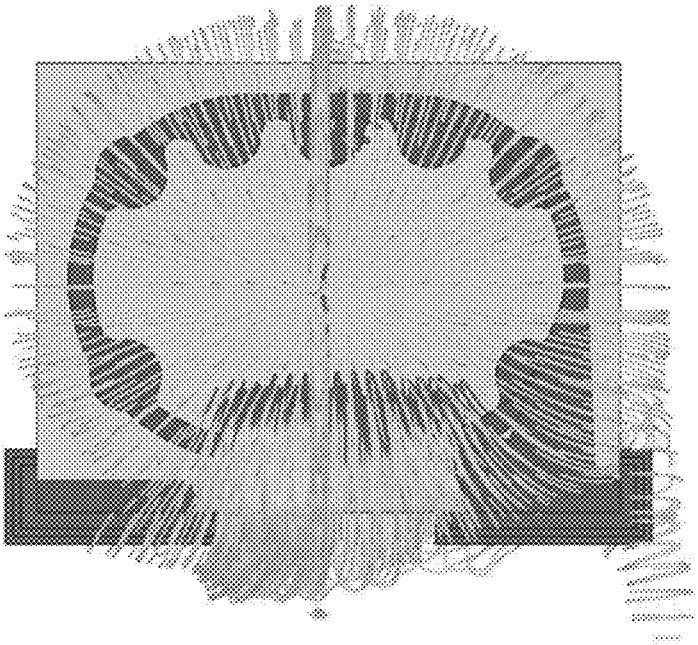
FIG. 7 is a view illustrating a formation of a magnetic field in a coil component according to an exemplary embodiment in the present disclosure.

FIG. 6 is a view illustrating a formation of a magnetic field in a coil component according to a comparative example and FIG. 7 is a view illustrating a formation of a magnetic field in a coil component according to an exemplary embodiment in the present disclosure.

The coil component according to the comparative example illustrated in FIG. 6 has both ends of the internal coil which are formed toward both end surfaces of the body part, while the coil component according to an exemplary embodiment in the present disclosure illustrated in FIG. 7 has both ends of the internal coil which are formed toward one end surface of the body part.

It may be seen that in the coil component according to the comparative example as illustrated in FIG. 6, the magnetic field is induced and distributed along external electrodes of both sides thereof, while in the coil component according to an exemplary embodiment in the present disclosure as illustrated in FIG. 7, as the external electrodes are formed toward only one side thereof, a size of the magnetic field induced along the external electrodes is decreased, particularly, the magnetic field is strongly formed toward a center portion of the mounting surface.

This is because the first external electrode 141 and the second external electrode 142 are formed to be spaced apart from each other on the same side portion as each other, and no external electrode is formed between the first external electrode 141 and the second external electrode 142.

That is, an influence of the external electrodes on a flow of magnetic flux may be significantly reduced by significantly reducing an entire area of the external electrodes, and the flow of magnetic flux may be smoothly performed accordingly.

In addition, resistance values of the external electrodes acting as resistors are significantly reduced, and Q characteristics of the coil component may be thus improved.

As set forth above, according to the exemplary embodiments in the present disclosure, the high Q characteristic for the small inductor may be obtained.

While exemplary embodiments have been shown and described above, it will be apparent to those skilled in the art that modifications and variations could be made without departing from the scope of the present invention as defined by the appended claims.

What is claimed is:

1. A coil component comprising:

a body including an internal coil and having an upper surface and a lower surface opposing each other in a thickness direction thereof and a first end surface and a second end surface opposing each other in a length direction thereof, the internal coil having central axis parallel to a width direction of the internal coil;

a first external electrode connected to a first end of the internal coil;

a second external electrode connected to a second end of the internal coil, wherein the first external electrode and the second external electrode are disposed on a first side portion of the lower surface of the body; and dummy external electrodes having shape and position symmetrical to the external electrodes relative to a longitudinal center line of the body.

2. The coil component of claim 1, wherein the first external electrode and the second external electrode protrude from the first side portion of the lower surface of the body and an outer portion of the first end surface of the body.

3. The coil component of claim 2, wherein the dummy external electrodes protrude from an other side portion of the lower surface of the body opposing the first side portion and an outer portion of the second end surface of the body.

4. The coil component of claim 3, wherein the dummy external electrodes are electrically insulated from the internal coil.

5. The coil component of claim 3, wherein the first external electrode and the second external electrode are disposed on the first side portion of the lower surface of the body adjacent to the first end surface of the body, and the dummy external electrodes are disposed on the second side portion of the lower surface of the body adjacent to the second end surface of the body.

6. The coil component of claim 1, wherein the internal coil includes:

a plurality of coil patterns disposed on a plurality of body sheets, respectively;

at least one via electrode penetrating through at least one insulating layer disposed between the plurality of body sheets;

a first internal electrode pattern connected to the first end of the internal coil and the first external electrode; and a second internal electrode pattern connected to the second end of the internal coil and the second external electrode.

7. The coil component of claim 6, wherein an exposed shape of the first internal electrode pattern corresponds to an exposed shape of the second internal electrode pattern.

8. The coil component of claim 7, wherein a shape of the first internal electrode pattern is different from a shape of the second internal electrode pattern.

9. A coil component comprising:

a body including an internal coil and having an upper surface and a lower surface opposing each other in a thickness direction thereof and a first end surface and a second end surface opposing each other in a length direction thereof;

a first external electrode connected to a first end of the internal coil;

a second external electrode connected to a second end of the internal coil, wherein the first external electrode and the second external electrode are disposed on the first end surface of the body and overlap each other in a direction parallel to the central axis of the internal coil; and first and second dummy external electrodes having shape and position symmetrical respectively to first and second external electrodes relative to a longitudinal center line of the body.

10. The coil component of claim 9, wherein the first and second dummy external electrodes are disposed on the second end surface of the body.

11. The coil component of claim 10, wherein the first external electrode and the second external electrode are disposed on an outer portion of the body across a first side portion of the lower surface of the body and the first end surface of the body.

12. The coil component of claim 11, wherein the first and second dummy external electrodes are disposed on an outer portion of the body across a second side portion of the lower surface of the body opposing the first side portion and the second end surface of the body.

13. The coil component of claim 10, wherein the internal coil includes:

a plurality of coil patterns disposed on a plurality of body sheets, respectively;

at least one via electrode penetrating through at least one insulating layer disposed between the plurality of body sheets;

a first internal electrode pattern connected to the first end of the internal coil and the first external electrode; and a second internal electrode pattern connected to the second end of the internal coil and the second external electrode.

14. The coil component of claim 13, wherein an exposed shape of the first internal electrode pattern corresponds to an exposed shape of the second internal electrode pattern.

15. The coil component of claim 14, wherein a shape of the first internal electrode pattern is different from a shape of the second internal electrode pattern.

16. A coil component comprising:

an internal coil shaped as a spiral around a central axis and having a first end and a second end disposed on a same side of the central axis;

a body enclosing the internal coil and having a thickness direction perpendicular to the central axis of the internal coil;

a first external electrode connected to a first end of the internal coil and disposed on a first external surface of the body, the first external surface being perpendicular to the thickness direction of the body;

a second external electrode connected to a second end of the internal coil and disposed on the first external surface of the body, the second external electrode being disposed on the same side of the central axis as the first external electrode; and a dummy external electrode having shape and position symmetrical to at least one of the first external electrode and the second external electrode relative to a longitudinal center line of the body.

17. The coil component of claim 16, wherein the dummy external electrode is disposed on the first external surface on an opposite side of the central axis as the first and second ends of the internal coil.

18. The coil component of claim 17, wherein the dummy external electrode is electrically insulated from the internal coil.

19. The coil component of claim 16, wherein the dummy external electrode is disposed on a second external surface opposite the first external surface with respect to the central axis.

20. The coil component of claim 1, wherein the first external electrode and the second external electrode overlap each other in the width direction.

* * * * *